US005524360A

United States Patent [19]

Virta et al.

[11] Patent Number: 5,524,360

[45] Date of Patent: Jun. 11, 1996

[54] METHOD AND DEVICE FOR VENTILATING POCKET SPACES IN A MULTI-CYLINDER DRYER OF A PAPER MACHINE

[75] Inventors: Raimo Virta; Vesa Vuorinen, both of Turku, Finland

[73] Assignee: Valmet Paper Machinery Inc., Helsinki, Finland

[21] Appl. No.: 219,651

[22] Filed: Mar. 29, 1994

[30] Foreign Application Priority Data

Apr. 5, 1993 [FI] Finland ..... 931545

[51] Int. Cl.[6] ..... F26B 3/00

[52] U.S. Cl. ..... 34/457; 34/115; 34/117

[58] Field of Search ..... 34/113, 114, 116, 34/117, 457, 120, 123

[56] References Cited

U.S. PATENT DOCUMENTS

| | | | |
|---|---|---|---|
| 4,602,439 | 7/1986 | Eskelinen et al. | 34/123 |
| 4,694,587 | 9/1987 | Eskelinen | 34/117 |
| 4,899,463 | 2/1990 | Heikkila et al. | 34/23 |

FOREIGN PATENT DOCUMENTS

| | | |
|---|---|---|
| 80103 | 12/1988 | Finland . |
| 82095 | 3/1989 | Finland . |
| 921629 | 4/1992 | Finland . |

*Primary Examiner*—Henry A. Bennett
*Assistant Examiner*—Susanne C. Tinker
*Attorney, Agent, or Firm*—Steinberg, Raskin & Davidson

[57] ABSTRACT

A method and apparatus for ventilating pocket spaces in a multi-cylinder dryer of a paper machine, in particular a high-speed paper machine whose running speed is higher than about 800 meters per minute, in the area of a so-called twin-wire draw. In the twin-wire draw, the drying cylinders in the drying group are arranged in two rows placed one above the other, in which rows the successive cylinders are placed in the upper row and in the lower row as interlocked. In each cylinder group, there are two drying wires, an upper wire and a lower wire for pressing the paper web against heated faces of the drying cylinder while being guided by guide rolls placed in gaps between the cylinders. The paper web runs as free draws between the rows of cylinders. Pocket spaces are formed in the area between the free draws of the web and the upper wire and its guide roll and the drying cylinder in the lower row and, in a corresponding manner, adjacent pocket spaces are formed in the area between the free draws of the web, the lower wire, its guide roll, and the drying cylinder in the upper row. The pocket spaces are ventilated by pumping air induced by the wire in the multi-cylinder dryer, wherein, at the inlet side of the guide roll, the wire pumps air into the pocket spaces through the wire and wherein the wire pumps air out of the pocket spaces at the outlet side of the guide roll of the wire. Air being pumped out through the wire on its run at the outlet side from the guide roll to the following cylinder is limited as compared with free pumping-in and pumping-out so as to control the pressure level and/or the flow status in the pocket spaces.

20 Claims, 5 Drawing Sheets

METHOD AND DEVICE FOR VENTILATING POCKET SPACES IN A MULTI-CYLINDER DRYER OF A PAPER MACHINE

BACKGROUND OF THE INVENTION

The present invention relates to a method for ventilating pocket spaces in a multi-cylinder dryer of a paper machine, in particular a high-speed paper machine whose running speed is higher than 800 meters per minute, in the area of a so-called twin-wire draw in which drying cylinders in the drying group are arranged in two rows placed one above the other. Successive cylinders are placed in the upper row and in the lower row so as to form an interlocking structure. In each cylinder group there are two drying wires, an upper wire and a lower wire, by whose means the paper web is pressed against the heated faces of drying cylinders, while being guided by guide rolls placed in the gaps between the cylinders. The paper web runs as a free draw between the rows of cylinders so that the pocket spaces are formed in the area between the free draws of the web and the upper wire and its guide roll and the drying cylinder in the lower row. In a corresponding manner, an adjacent pocket spaces are formed in the area between the free draws of the web, the lower wire, its guide roll, and the drying cylinder in the upper row. The pocket spaces are ventilated by pumping air induced by the wire in the multi-cylinder dryer, wherein, at the inlet side of the guide roll, the wire pumps air into the pocket spaces through the wire and wherein the wire pumps air out of the pocket spaces at the outlet side of the guide roll of the wire.

Further, the invention relates to an apparatus for ventilating a pocket space in a multi-cylinder dryer of a paper machine in the area of a so-called twin-wire draw, in which drying cylinders in the drying group are arranged in two horizontal rows placed one above the other. Successive cylinders are placed in the upper row and in the lower row in an interlocking relationship. In each cylinder group, there are two drying wires, an upper wire and a lower wire, by whose means the paper web is pressed against the heated drying-cylinder faces, while being guided by guide rolls placed in the gaps between the cylinders. The paper web runs as free draws between the cylinder rows so that the pocket space is formed in the area between the free draws of the web and the upper wire and its guide roll and the drying cylinder of the lower row. In a corresponding manner, an adjacent pocket space is formed in the area between the free draws of the web, the lower wire, its guide roll, and the drying cylinder in the upper row.

In the multi-cylinder dryers in paper machines, in guiding the paper web, either so-called twin-wire draw and/or single-wire draw is/are employed. In a twin-wire draw, the heated drying cylinders are arranged in two horizontal rows placed one above the other. Successive cylinders are placed in the upper row and in the lower row as interlocked. In such a case, in each cylinder group, there are two drying wires, a so-called upper wire and a lower wire, by whose means the paper web is pressed against the heated faces of the drying cylinders, while being guided by the guide rolls arranged in the gaps between the cylinders. In a twin-wire draw, the web usually has free, unsupported draws as their runs between the rows of cylinders.

In a single-wire draw, only one drying wire is used in the drying cylinder group, the paper web running on support of this wire through the whole group. In the prior art, in a single-wire draw, two rows of drying cylinders placed one above the other were commonly used, but, at present, usually just one row of drying cylinders is used, whereas the other row comprises reversing suction rolls with no heating, such as the assignee's VAC-rolls™. These cylinders, reversing suction rolls and drying wire are arranged in such away that the drying wire presses the web to be dried against the cylinder face, while on the reversing rolls the web is at the side of the outside curve.

A single-wire draw is usually employed in the first and second drying groups in the dryer section of a paper machine, because at the initial stage of drying the web requires constant support of the wire. As the drying makes progress, the strength of the web becomes higher and it is possible to use twin-wire groups, in which the web has free, unsupported draws between the rows of cylinders, because, in twin-wire draw, generally better drying capacity per unit of area of the web is achieved.

In the dryer sections of high-speed (velocity equals 800–1600 meters per minute) paper machines, it has been noticed that the pumpings of air induced by the wires constitute a problem for the runnability in the first twin-wire areas. Problems arising from such pumpings of air also occur in such low-speed paper machines in which the supported single-wire draw of the paper web at the beginning of the machine is short or in which wire fabrics are used that are very open in view of flows of air.

The problems have arisen from the fact that the pumping-out of air induced by the wires is, because of the same speed, usually larger than the pumping-in of air induced by the wires, in which case detrimental transverse flows are produced in the pocket spaces. Moreover, the pumpings of air induced by the wires produce interference flows detrimental for the runnability of the paper web.

As is known from the prior art, in the pocket ventilation of cylinder groups in the dryer sections of paper machines, blow-in boxes have been used, by whose means blowing has been applied through the wire. In conventional pocket ventilation, the equalizing of the pressure and the air-conditioning in the pocket space have been carried out by increasing the air flow at the inlet side of the wire. However, in these applications, a drawback has consisted of the interference with the paper web as a result of increased blowing of air, of intensification of the flowing through, and, further, of increased fluttering of the free draws of the paper web especially in high-speed paper machines, in which the pumpings of air induced by the wires have had a strong impact on the air flows and the air equilibrium in the pocket. This is why it has been necessary to reduce the permeability to air of the wires and/or it has been necessary to restrict the blowings of air in the conventional pocket ventilation. This has come especially from the fact that the problem in the pocket spaces is in itself not so much the moisture level present therein, but the problem is the pressure level present in the pocket spaces and in particular the adjustability of the pressure level, because a pocket ventilation that is in itself adequate at high speeds has been achieved by means of the pumpings of air induced by the wire.

OBJECTS AND SUMMARY OF THE INVENTION

Accordingly, it is an object of the present invention to provide a method and apparatus for the ventilation of a pocket space in a multi-cylinder dryer of a paper machine in which the above problems of the prior-art applications are substantially eliminated.

It is another object of the present invention to provide ventilation of the pocket space and an air equilibrium in the pocket space with a smaller flow of air at the inlet side of the wire, compared with the prior art applications, in which smaller flow of air the pressure level of the negative pressure formed in the outlet nip at the wire guide roll has been altered.

In view of achieving the objects stated above and others, the method in accordance with the invention is mainly characterized in that, in the method, pumping-out of air through the wire by the wire on its run at the outlet side from the guide roll to the following cylinder is limited as compared with free pumping-in and pumping-out so as to control the pressure level and/or the flow status in the pocket spaces.

In the apparatus in accordance with the invention, in the area of the run of the wire from the guide roll to the following cylinder, obstructing means, such as an obstructing device, is provided which reduces the amount of air that escapes from the pocket space.

In the present invention, the pumping-out of air induced by the wire is limited by partly preventing the flow of air escaping through the wire at the side of the outlet nip of the wire guide roll, for example, by about 10% to about 50%, in particular in an area in which the air is drier, so that a status of equilibrium of air is achieved in the pocket, i.e., frequently a slight positive pressure. The device that obstructs the pumping-out of air, i.e., reduces the amount of air that escapes out of the pocket, is based either on an obstructing wall and/or on an obstructing blowing and is placed so that it is effective in the area of the nip of negative pressure of the guide roll opened at the outlet side of the wire guide roll and/or in the area of the wire that departs from the guide roll. At the same time, direct pumping of dry air around the wire guide roll, i.e., a so-called short-circuit air, is substantially prevented.

The flow of air, if any, that restricts the pumping-out of air is blown by means of a particular nozzle that follows the air directly into the areas of the opening nip of negative pressure and the free wire face, which are defined by the roll and the wire.

It should be noted that the principal object of the invention is just partly to limit the pumping-out at the closing nip at the outlet side of the wire, and, thus, the equilibrium in the pocket space is reached by partly obstructing the outgoing air flow in particular at the outlet side of the wire guide roll. The state of equilibrium of air in the pocket is adjusted so that it becomes better in view of the runnability so that detrimental transverse flows do not occur or that their amount is at least minimized. The state of equilibrium in the pocket and adequate pocket ventilation are frequently already achieved by means of the natural pumping-in by the wire, i.e., with a minimum air quantity, with which the optimal runnability is obtained.

In the invention, the ventilation of the pocket is arranged through the pressurized nip at the inlet side of the wire. The blowing is accomplished so that the dry air that is blown into the pocket does not alter the state of pressure in the pocket. Since the air that is pumped into the pocket space comes primarily from the pressurized nip of the guide roll at the inlet side of the web, the layer of air that follows the face of the guide roll displaces the corresponding layer of air that follows the wire in the nip at the inlet side of the wire.

Dry air is fed freely into the nip at the inlet side of the wire, in which case it displaces some of the moist air coming from the face of the cylinder. Dry air can be fed into different areas for the purpose of correcting the profile. This blowing can be divided, for example, into adjustable blocks across the machine. It is important that the flow quantities at the inlet side do not affect the equilibrium in the pocket and that the flow at the inlet side is kept equal to the free wire pumping, whereby the run of the web is as stable as possible.

In high-speed paper machines, the pumping quantity of the wire's own is capable of supplying an adequate amount of air into the pocket space, and this freely metered dry air provides a better correction of the profile when the equilibrium and the flow pattern in the pocket are retained, because the air flow at the inlet side is not increased from the natural pumping.

In a preferred embodiment of the invention, the obstruction blowing is accomplished at the outgoing side, and the uniform supply of dry air is accomplished at the incoming side, whereby a simple construction is provided in which there are no parts placed at the vicinity of the cylinder. In the invention, it is possible to use, e.g., an obstruction device alone and/or block adjustments of the air-profile correction.

The obstruction-blow nozzle in the apparatus in accordance with the invention has a width equal to the width of the whole web, and it is shaped so that adequate sealing against the wire is obtained. The apparatus in accordance with the invention for ventilation of a pocket space in a multi-cylinder dryer of a paper machine is placed so that the required safety clearance remains between the blow nozzle and the cylinder.

In both of the blow nozzles in the apparatus, generally and preferably, air of the same blow system is used; since the status of the air that is blown into the pocket is, at the nozzle, lower than the counter-blowing, the direct blowing against the roll acts as a so-called pressure equalizer. As the sealing between the nozzles against the roll, it is possible to use, e.g., the modes as described in the assignee's Finnish Patent Application No. 921629.

The invention can be applied to all normal applications of twin-wire draw in which it is possible to use ventilation taking place through the wire.

Other advantages and characteristic features of the invention will come out later in the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
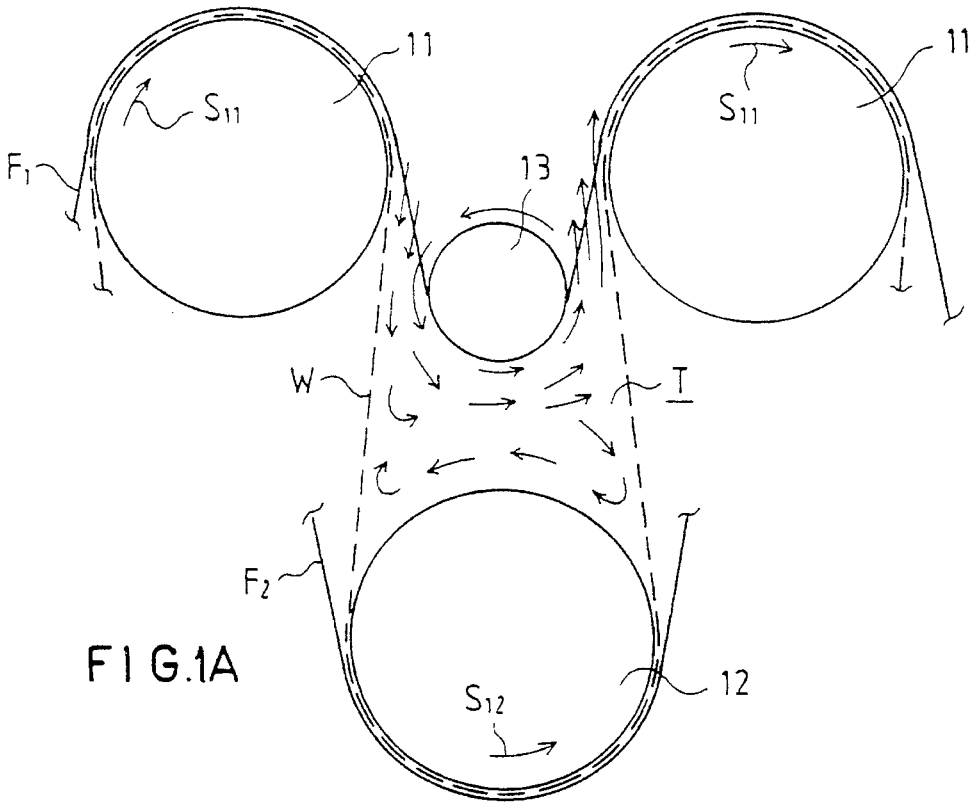
FIG. 1A is a schematic illustration of conventional prior art air flows in a pocket space.

FIG. 1A illustrates the air flows in a prior art pocket space T, which air flows are indicated in the figure by means of arrows. Air is pumped into the pocket space by the effect of the pumping induced by the wire $F_1$ into the nip at the inlet side of the wire, and air is removed out of the pocket from the nip at the outlet side of the wire $F_1$. Further, part of the departing air flow may follow the guide roll 13 in a so-called short-circuit air flow.

Figure 1B:
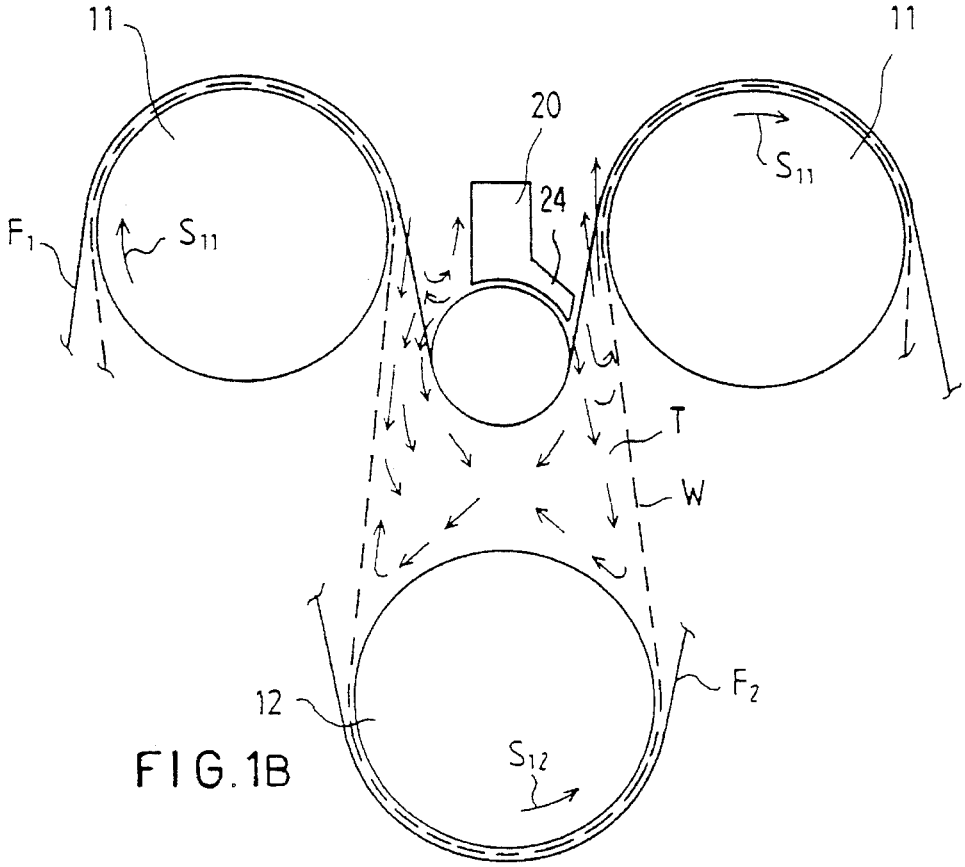
FIG. 1B is a schematic illustration of the air flows effective in an embodiment in accordance with the present invention.

FIG. 1B is a schematic illustration of the air flows in the pocket space T, which are effective in connection with an arrangement in accordance with the present invention and which are indicated by means of arrows. The air flow that is blown out of the pocket ventilation device 20 partly prevents the air flow at the inlet side of the wire $F_1$ while diverting some of the moist air coming from the cylinder 11. The moist air is replaced by the dry air coming out of the pocket ventilation device 20. Moreover, the nozzle 24 of the pocket ventilation device arranged at the outlet side of the wire $F_1$ blows air, which partly prevents the pumping-out of air induced by the wire $F_1$ and, at the same time, prevents the so-called short-circuit air flow. In the arrangement in accordance with the invention, the flow pattern is changed in the manner shown in the figure, and the ventilation of the pocket T is achieved more efficiently with a smaller amount of air.

Figure 2:
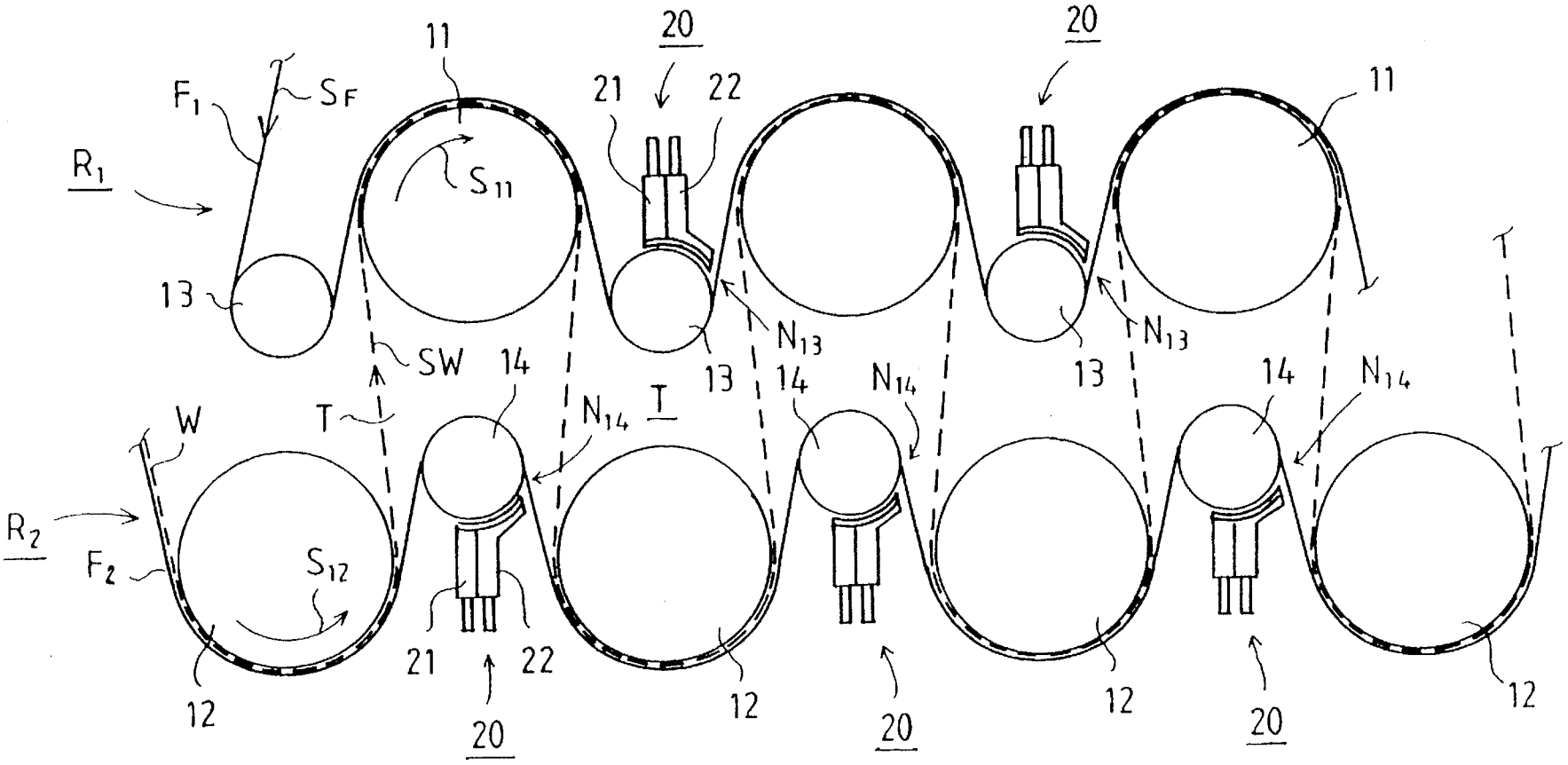
FIG. 2 is a schematic illustration in part of a multi-cylinder dryer in a paper machine, in which a pocket ventilation apparatus and method of the present invention is used.

As shown in FIG. 2, the multi-cylinder dryer section of a paper machine in which twin-wire draw is employed comprises two rows of drying cylinders $R_1$,$R_2$. In FIG. 2, the drying cylinders in an upper one of the rows $R_1$ are denoted by reference numeral 11, and the drying cylinders in a lower one of the rows $R_2$ are denoted by reference numeral 12. The upper wire $F_1$ runs meandering over guide rolls 13 and the drying cylinders 11 in the upper row $R_1$. The lower wire $F_2$ runs meandering over the drying cylinders 12 and guide rolls 14 in the lower row $R_2$. The paper web W runs across the portion between the drying cylinders 11 and 12 in the upper row and in the lower row as a free draw without the support of the corresponding drying wire $F_1$,$F_2$. The paper web W to be dried runs in the direction indicated by the arrow SW. The drying cylinders 11 in the upper row $R_1$ revolve in the direction indicated by the arrow $S_{11}$, and the drying cylinders 12 in the lower row revolve in the direction indicated by the arrow $S_{12}$. A pocket space T is defined by the free draws of the web W, by the upper wire $F_1$ and by the guide roll 13 that guides the upper wire, as well as by the drying cylinder 12 in the lower row $R_2$. An adjacent pocket space T is defined by the free draws of the web W and by the drying cylinder 11 in the upper row $R_1$ and by the lower wire $F_2$ as well as by the guide roll 14 that guides the lower wire.

In the exemplifying embodiment shown in FIG. 2, both inside the loop formed by the upper wire $F_1$, outside the pocket space T, between the guide roll 13 and the drying cylinder 11, a pocket ventilation device 20 is arranged. Likewise, a pocket ventilation device 20 is arranged inside the loop of the lower wire $F_2$, between the guide roll 14 and the drying cylinder 12. The pocket ventilation devices 20 are placed at the side of pumping-out of the guide rolls 13,14 and the wire $F_1$,$F_2$, i.e., in the area of the opening nip $N_{13}$,$N_{14}$ of negative pressure of the guide roll 13,14. In the exemplifying embodiment shown in FIG. 2, the pocket ventilation devices 20 are provided with two air chambers 21,22.

Figure 3:
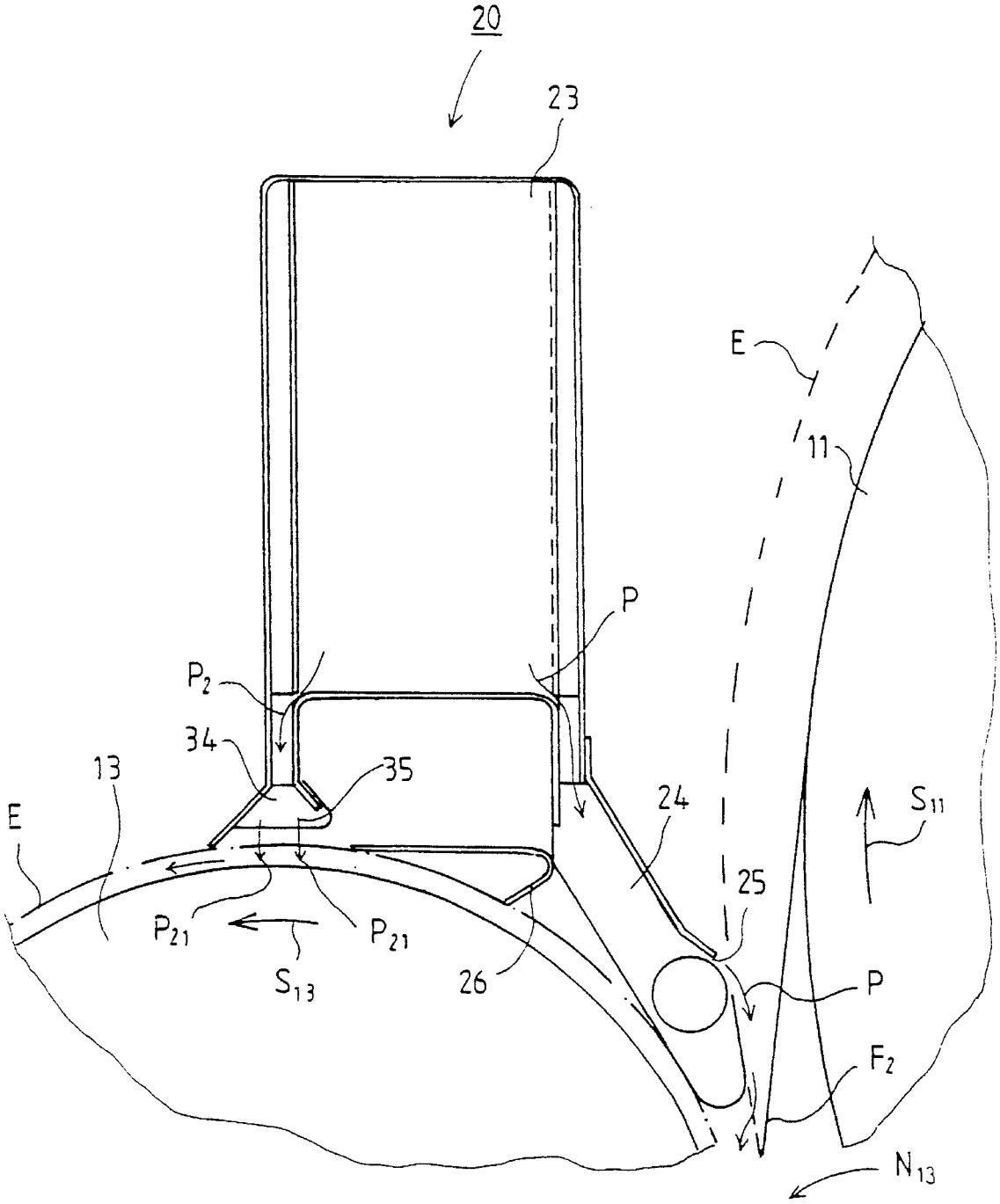
FIG. 3 is a schematic sectional view of an exemplifying embodiment of a pocket ventilation apparatus in accordance with the invention.

FIG. 3 is a schematic sectional view of a pocket ventilation device 20 in accordance with the invention, which comprises one air chamber 23 instead of the two air chambers 21,22 provided above in the exemplifying embodiment shown in FIG. 2. The pocket ventilation device 20 of this embodiment is arranged between the guide roll 13 and the drying cylinder 11 so that a nozzle 24 of the ventilation device 20 is placed at the side of pumping-out of the wire F in the area of the opening nip $N_{13}$ of negative pressure of the guide roll 13.

In FIG. 3, the dashed and dashed-dotted lines E represent the safety clearances of the pocket ventilation device 20 in relation to the drying cylinder 11 and to the guide roll 13. The safety clearance in relation to the drying cylinder 11 is larger than about 50 mm, preferably in the range of from about 50 mm to about 150 mm. The safety clearance in relation to the guide roll 13 is in the range of from about 10 mm to about 30 mm.

An air flow P is passed to the nozzle 24 at the obstruction side out of the air chamber 23 of the pocket ventilation device 20. From the nozzle, the air flow P is blown through a nozzle opening 25 as a blowing directed into the nip $N_{13}$ of negative pressure of the guide roll 13. Between the nozzle 24 and the guide roll 13, awkward seals are not required, but a plate 26 that obstructs the circulation of air prevents flowing of air along with the face of the guide roll 13 to circulate in the direction $S_{13}$. Out of the air chamber 23 of the pocket ventilation device 20, at the ventilation side, air is blown as the air flow $P_2$ into the nozzle 34, from which it is blown through the nozzle openings 35 against the face of the guide roll 13 as blowings $P_{21}$. The blowing $P_{21}$ taking place out of the nozzle openings 35 is directed so that the blowing does not alter the equilibrium of air in the pocket, but it just affects the moisture profile. The amount of air flowing through the wire does not have to be changed at this side. At this side, it is also possible to use regulation in blocks in the transverse direction, by means of which regulation the blow quantities of dry air are adjusted.

Figure 4:
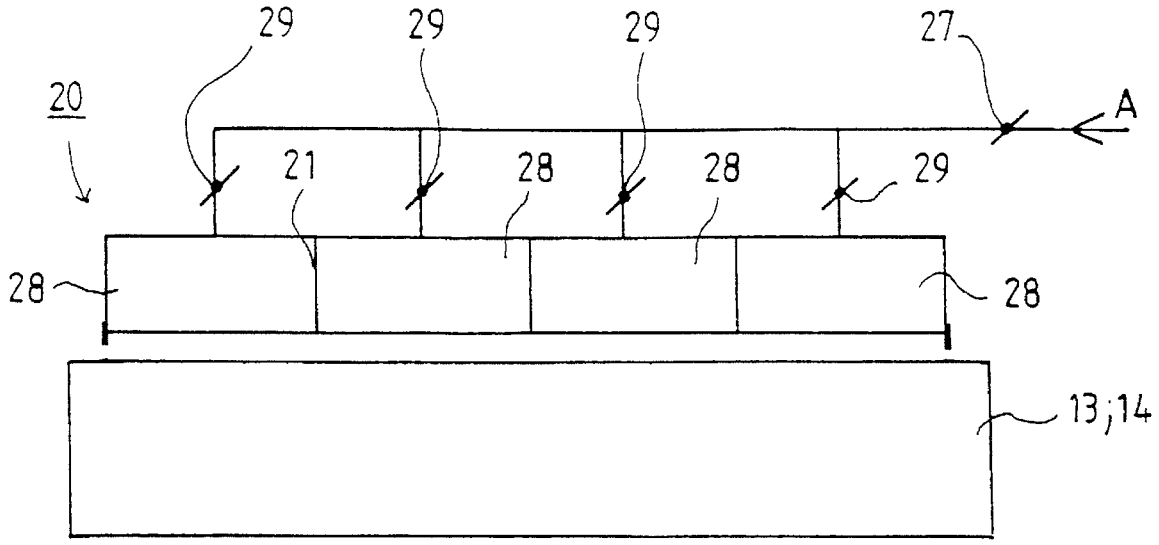
FIG. 4 is a schematic illustration of the intake-air arrangement at the ventilation side in a pocket ventilation apparatus in accordance with the invention.

Referring to FIG. 4, the input air at the ventilation side of the pocket ventilation device 20 is passed along a duct A through a regulation valve 27 into blocks 28 formed by the air chamber 21 at the ventilation side of the pocket ventilation device 20. The quantity of air passing into each partitioned block 28 is adjustable by means of a regulation valve 29, or other suitable regulation means. In this manner, it is possible to regulate the blowing in the transverse direction of the web W.

Figure 5:
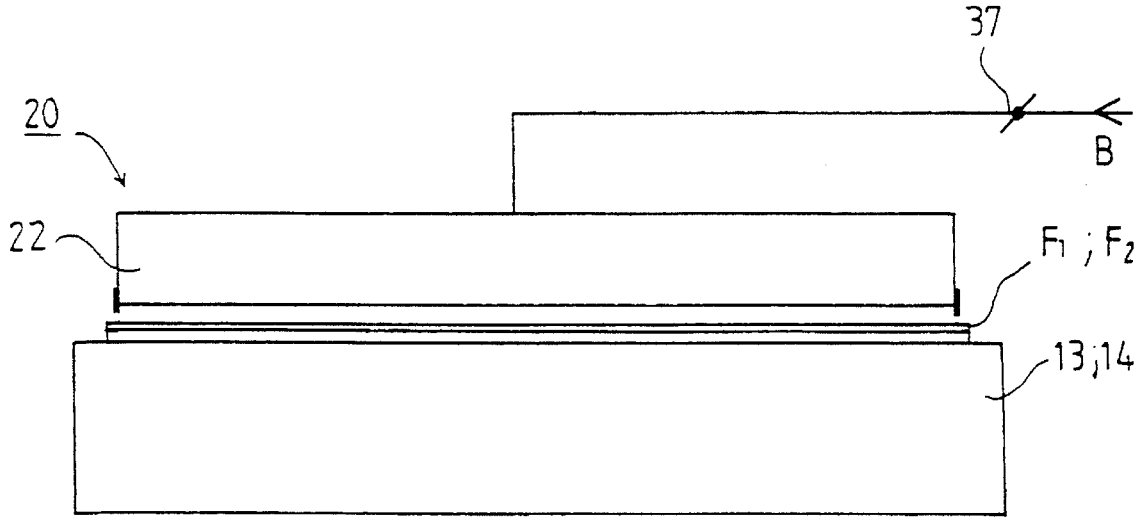
FIG. 5 is a schematic illustration of the intake-air arrangement at the obstruction side in a pocket ventilation apparatus in accordance with the invention.

FIG. 5 shows the passage of the input air at the obstruction side of the pocket ventilation device 20, which input air is passed along a duct B through the regulation valve 37 into the air chamber 22 at the obstruction side of the pocket ventilation device 20.

Figure 7:
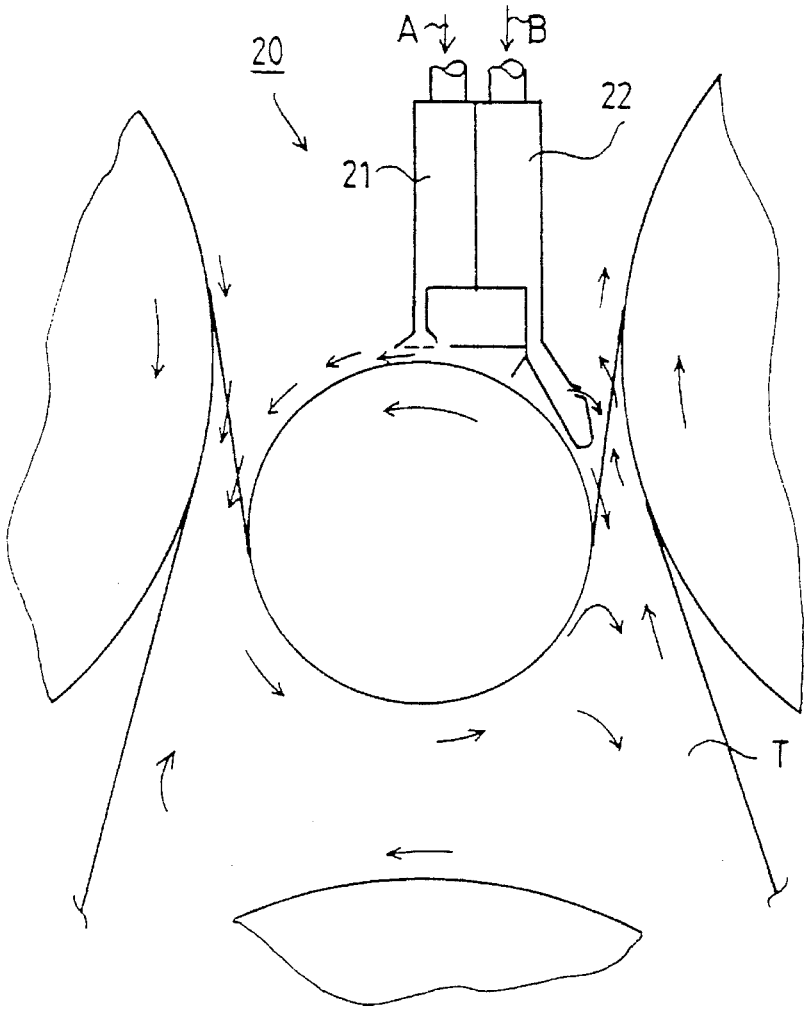
FIG. 7 is a schematic sectional view of a second exemplifying embodiment of the pocket ventilation apparatus in accordance with the invention.

The input air arrangements shown in FIGS. 4 and 5 are shown for a pocket ventilation device 20 having two chambers, such as the device illustrated schematically in FIG. 2, and a more detailed sectional view of this type of device is illustrated in FIG. 7.

Figure 6:
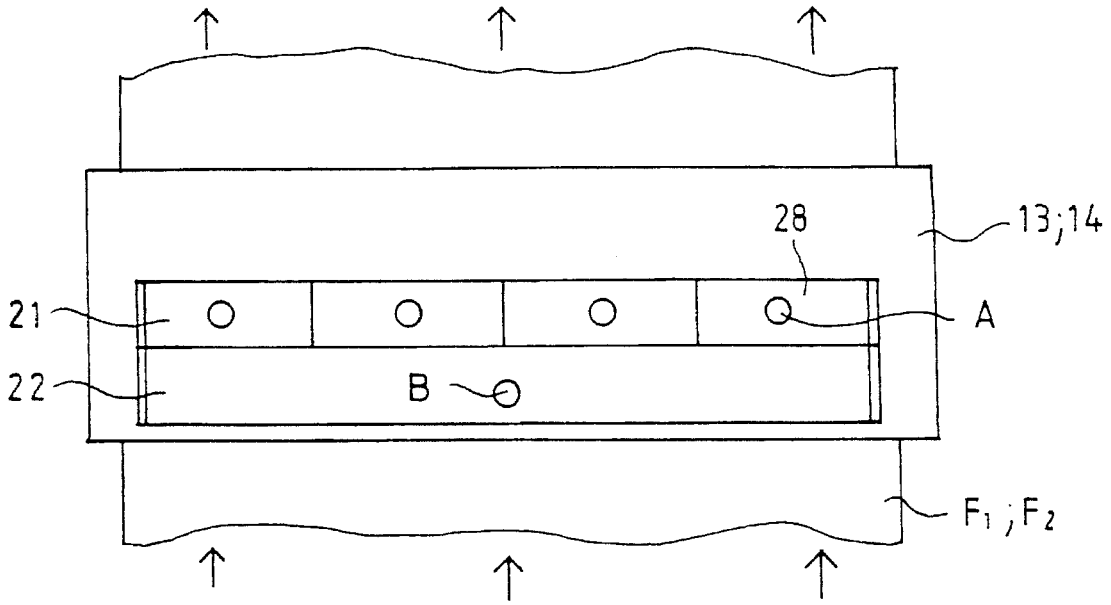
FIG. 6 is a schematic illustration of a pocket ventilation apparatus in accordance with the invention viewed from above.

FIG. 6 is a schematic top view of a pocket ventilation device 20 having two chambers 21,22, in which the supply of air A at the ventilation side is directed into blocks 28, which together form a chamber 21. The chamber 22 is the air chamber at the obstruction side, to which the air flow B is passed in the manner shown in FIG. 5.

FIG. 7 is a schematic sectional view of a pocket ventilation device in accordance with the invention, in which there are two air chambers 21,22, i.e., the air chamber 21 at the ventilation side and the air chamber 22 at the obstruction side. The input air passages are denoted by the reference arrows A and B. In the other respects, the pocket ventilation device 20 shown in FIG. 7 is similar to that shown in FIG. 2, and the same reference numerals are used for corresponding components. The arrows illustrate the circulation of air in the pocket space T.

In the exemplifying embodiments described above, the obstruction device which is placed at the outlet side of the wire guide roll and which reduces the amount of air departing from the pocket is based on obstruction blowing. The obstruction device can also be accomplished so that the pumping-out of air through the wire is limited by means of an obstructing wall or by means of brush sealing.

The examples provided above are not meant to be exclusive. Many other variations of the present invention would be obvious to those skilled in the art, and are contemplated to be within the scope of the appended claims.

We claim:

1. A method for controlling the ventilation of pocket spaces in a drying group of a multi-cylinder dryer of a paper machine, which drying group has a twin-wire draw in which drying cylinders are arranged successively in two rows situated one above the other, and wherein each of the drying groups includes an upper wire and a lower wire for pressing a paper web against heated faces of the drying cylinders while the web is guided by guide rolls arranged in gaps between the drying cylinders, the paper web runs as a free draw between an upper row of drying cylinders and a lower row of drying cylinders so that pocket spaces are formed in areas between the free draws of the web, the upper wire, guide rolls for the upper wire and the drying cylinders in the lower row and in areas adjacent thereto defined between the free draws of the web, the lower wire, guide rolls for the lower wire, and the drying cylinders in the upper row, the method comprising the steps of:

ventilating said pocket spaces by pumping air through the wires into said pocket spaces at an inlet side thereof and pumping air through the wires out of said pocket spaces at an outlet side thereof, regulating the flow of air being pumped through the wires into said pocket spaces at the inlet side, and obstructing the flow of air being pumped out of said pocket spaces through the wires at the outlet side thereof to control at least one of the level of air pressure in said pocket spaces and the air flow in said pocket spaces.

2. The method of claim 1, wherein the obstructing step comprises the step of directing an obstruction-air blowing to prevent air from being pumped out of said pocket spaces at the outlet side thereof on a run of the wires between the guide rolls and one of the drying cylinders following a respective one of the guide rolls.

3. The method of claim 1, wherein the obstructing step comprises the step of providing an obstructing wall to prevent air from being pumped out of said pocket spaces at the outlet side thereof on a run of the wires between the guide rolls of the wires and one of the drying cylinders following a respective one of the guide rolls.

4. The method of claim 3, further comprising the step of arranging said obstructing wall outside of said pocket spaces and adjacent to said guide rolls.

5. The method of claim 1, further comprising the step of directing an air flow toward the inlet side of said pocket spaces to displace part of the air that follows the wires and comes from a second one of the drying cylinder preceding each of said guide rolls.

6. The method of claim 5, further comprising the step of directing the air flow through a nozzle directly against a face of said guide rolls to be carried into said pocket spaces at the inlet side thereof.

7. The method of claim 1, further comprising the step of directing air into the pocket space to ventilate the pocket space.

8. The method of claim 3, further comprising the step of positioning said obstructing wall at least at a safety clearance distance from said drying cylinders following said guide rolls in the running direction of the web and from said guide rolls.

9. The method of claim 1, further comprising the steps of directing an air flow from a chamber through a first nozzle against a face of each of said guide rolls to be carried into said pocket spaces at the inlet side thereof, and directing an obstructing-air flow from the chamber through a second nozzle to the outlet side of said pocket spaces.

10. The method of claim 1, further comprising the steps of directing an air flow from a first chamber through first nozzle means against a face of each of said guide rolls to be carried into said pocket spaces at the inlet side thereof, and directing an obstructing-air flow from a second chamber through second nozzle means to the outlet side of said pocket spaces.

11. The method of claim 10, further comprising the steps of partition said second air chamber into blocks in a transverse direction to each of said guide rolls, and regulating the flow of air into said blocks to regulate the air flow via said second nozzle means in the transverse direction.

12. The method of claim 1, wherein the amount of air being pumped out of said pocket spaces through the wires at the outlet side thereof is reduced to a level from about 10% to about 50% less than the amount of air normally being pumped out of said pocket spaces.

13. Apparatus for controlling the ventilation of a pocket space in a drying group of a multi-cylinder dryer of a paper machine, which drying group has a twin-wire draw in which drying cylinders are arranged successively in two rows situated one above the other, and wherein each of the drying groups includes an upper wire and a lower wire for pressing a paper web against heated faces of the drying cylinders while the web is guided by guide rolls arranged in gaps between the drying cylinders, the paper web runs as free draws between the upper row of drying cylinders and the lower row of drying cylinders so that pocket spaces are formed in an area between the free draws of the web, the upper wire, guide rolls for the upper wire and the drying cylinders in the lower row and in areas adjacent thereto defined between the free draws of the web, the lower wire, guide rolls for the lower wire, and the drying cylinders in the upper row, the apparatus comprising means for ventilating said pocket spaces by pumping air through the wires into said pocket spaces at an inlet side thereof and pumping air through the wires out of said pocket spaces at an outlet side thereof, a frame arranged adjacent to one of the guide rolls, said frame including first nozzle means for directing an obstructing-air blow to the outlet side of the wires to regulate the flow of air being pumped from said pocket space through the wires, and regulating means for regulating the flow of air being pumped through the wires into said pocket space at the inlet side of the wires.

14. The apparatus of claim 13, wherein said regulating means comprise an obstructing wall constituting part of said frame.

15. The apparatus of claim 13, wherein said regulating means comprise second nozzle means for directing air against a face of said one of the guide rolls in the direction of rotation of said one of the guide rolls such that an air flow is carried along the face of said one of the guide rolls into said pocket space which displaces part of the air that follows the wire into said pocket spaces.

16. The apparatus of claim 15, wherein said first nozzle means is connected to a first air chamber and said second nozzle means is connected to a second air chamber.

17. The apparatus of claim 16, wherein said frame further comprises partition means for partitioning said second air chamber into blocks and additional regulation means for regulating the flow of air into said blocks, such that air flow in a transverse direction is regulatable.

18. The apparatus of claim 13, wherein said frame further comprises a plate situated in opposed relationship to a face of said one of the guide rolls, said plate obstructing circulation of air flowing along with the face of said one of the guide rolls.

19. The apparatus of claim 13, wherein said frame has a face situated at a distance from and adjacent to said one of the guide rolls and having a shape substantially corresponding to the shape of said one of the guide rolls, said frame extending substantially across a transverse width of the web.

20. The apparatus of claim 13, wherein said first nozzle means is situated proximate to said one of the guide rolls such that passage of air through the wire out of said pocket space is substantially prevented.

* * * * *